US005169111A

United States Patent [19]

Dunaj

[11] Patent Number: 5,169,111

[45] Date of Patent: Dec. 8, 1992

[54] COLLAPSIBLE STAND FOR SHADE UMBRELLAS

[76] Inventor: Raymond C. Dunaj, 601 Maple Ave., Neptune, N.J. 07753

[21] Appl. No.: 854,878

[22] Filed: Mar. 18, 1992

[51] Int. Cl.[5] ..... F16M 13/00

[52] U.S. Cl. ..... 248/523; 248/528; 248/910

[58] Field of Search ..... 248/511, 519, 521, 523, 248/528, 529, 530, 533; 150/154

[56] References Cited

U.S. PATENT DOCUMENTS

| | | | |
|---|---|---|---|
| 1,631,227 | 6/1927 | See | 248/910 X |
| 1,679,675 | 8/1928 | Lujan | 248/910 X |
| 2,806,131 | 9/1957 | Palmer | 248/910 X |
| 3,119,588 | 1/1964 | Keats | 248/519 X |
| 3,794,279 | 2/1974 | Kramer | 248/523 |
| 4,953,674 | 9/1990 | Landes | 150/154 X |
| 4,957,246 | 9/1990 | Kantor | 150/154 X |

FOREIGN PATENT DOCUMENTS

| | | | |
|---|---|---|---|
| 622680 | 5/1949 | United Kingdom | 248/910 |

*Primary Examiner*—J. Franklin Foss
*Attorney, Agent, or Firm*—Patrick J. Pinto

[57] ABSTRACT

A stand for receiving and stabilizing a shade umbrella. The stand includes a collapsible bag attached by its base portion to a rigid tubular sleeve member. The sleeve member is adapted for receiving and retaining various sizes of umbrella shafts passing therethrough. The collapsible bag may be charged, by way of its mouth, with sand, soil and the like to provide additional weight to the umbrella during windy conditions. After use the bag is emptied so that the stand may be collapsed for easy transport and storage.

9 Claims, 1 Drawing Sheet

COLLAPSIBLE STAND FOR SHADE UMBRELLAS

FIELD OF THE INVENTION

The present invention is believed to be found in the field of umbrella stands or supports and more particularly, to collapsible stands which are adapted to receive the shaft of a shade umbrella.

BACKGROUND OF THE INVENTION

Stands which are used to help in stabilizing umbrellas are known. Some examples of known related art are U.S. Pat. No. 3,317,168, issued to Ziph on May 2, 1967; U.S. Pat. No. 2,720,249, issued to Peterson on Oct. 11, 1955; U.S. Pat. No. 3,843,079, issued to Reisling on Oct. 22, 1974. The above cited prior art devices attach to the shaft of a shade umbrella which is typical of the Beach and/or Lawn umbrella. In each of the cited prior art devices the stand is of a rigid construction. This rigid construction not only uses space during use but adds bulk to items being transported to the desired site of umbrella installation. Reisling discloses a stand of solid construction which would also add weight to the bulk of the stand. It has been determined that there is a need for an umbrella stand which would be relatively compact; light in weight; adaptable to receiving the shaft of a shade umbrella; while providing a convenient means for adding weight to the umbrella when windy condition exist.

None of the known prior art devices provide the combination of features of the present invention.

SUMMARY OF THE INVENTION

It is object of this invention to provide and it does provide, a umbrella stand which is compact to transport and to store;

It is another object of this invention to provide and it does provide an umbrella stand which adjustably receives and secures the shaft of an umbrella;

It is a further object of this invention to provide and it does provide a stand for shade umbrellas which has a collapsible sack portion which is adapted to be filled with a suitable material when additional weight is required to stabilize the umbrella;

It is still yet a further object of this invention to provide and it does provide a stand for shade umbrellas which is capable of adapting to various contours upon which the stand rests.

In addition to the above summary, the following disclosure is detailed to insure adequacy and aid in the understanding of this invention. This disclosure however, is not intended to cover each new and inventive concept, no matter how it may be disguised either by variations in form or additions by further improvements. For this reason there have been chosen specific embodiments of my umbrella stand. These specific embodiments have been chosen for the purpose of full disclosure by means of illustration and description without placing limitations thereon.

BRIEF DESCRIPTION OF THE DRAWING

The figures in the drawings attached illustrate the essential features of the my novel stand wherein.

In the following description and in the claim, various details are identified by specific names for convenience. These names are intended to be generic in their application. The corresponding reference characters refer to like members throughout the several figures of the drawings.

The drawings accompanying and forming a part of this disclosure illustrate certain details of construction associated with the umbrella stand of the present invention. These details are for the purpose of explanation, but it is to be understood that structural details may be modified without departure from the concept and principles of the invention. It is anticipated that this invention may be employed or incorporated in forms other that as specifically shown.

DESCRIPTION OF THE INVENTION

Figure 1:
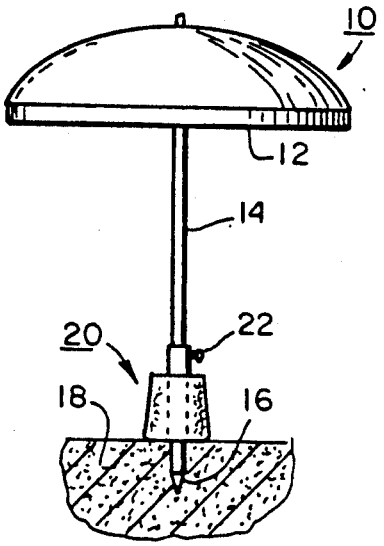
FIG. 1 represents an elevational view, partly diagrammatic and partly in section showing the stand of the present invention attached to a shade umbrella.

Referring to FIG. 1, there is shown an umbrella, generally indentified as 10. This type of umbrella 10 is generally used at the beach, on the lawn, around the pool and the like. The umbrella 10 usually has a canopy 12 and a shaft 14. When the umbrella 10 is used at the beach, it is customary to implant the end 16 of the shaft 14 into the sand or soil 18. The depth to which the end 16 is implanted in the soil is dependent on the ability of the soil 18 to hold the umbrella in a substantially erect array. It is sometimes necessary to implant the end 16 deeper into the soil 18 when windy conditions exist. Of course as the shaft 14 is implanted further into the soil 18 the clearance from the soil line to the canopy 12 is reduced.

Still referring to FIG. 1, the umbrella 10 is shown as being received in a stand, generally identified as 20. Stand 20 is adapted to receive the shaft 14 of the umbrella 10. The shaft 14 may protrude through the bottom of the stand 20 to allow the end 16 of the shaft 14 to be implanted in the ground. It is to be noted that the end 16 has been shown as being pointed for implanting but a shaft 14 having a tubular construction may also be accommodated. The shaft 14 of the umbrella 10 is secured to the stand 20 by way of an adjustable securing means 22.

Figure 2:
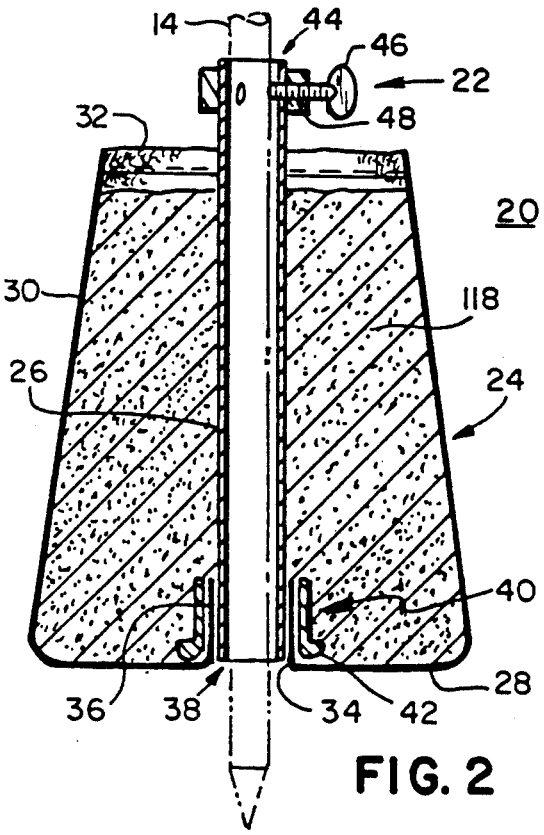
FIG. 2 represents a cross-sectional view, in an enlarged scale of the stand of the present invention when filled with a suitable material.
Figure 4:
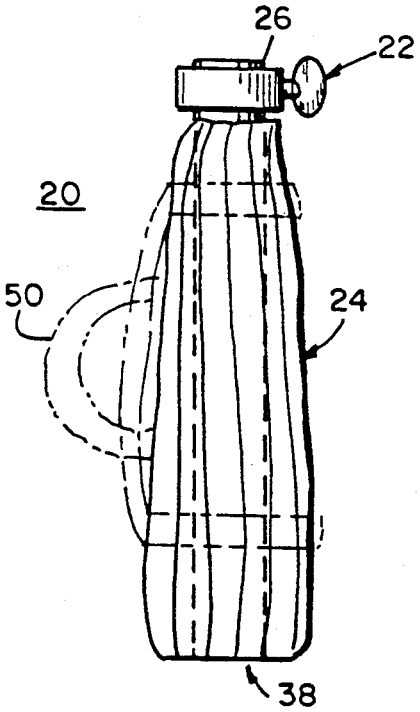
FIG. 4. represents a view of the stand of the present invention in the same scale as FIG. 2, This view particularly showing the stand in a collapsed condition.

Referring now to FIG. 2, the stand 20 includes a collapsible sack portion 24, and an elongated tubular sleeve 26. The collapsible sack 24 preferrably is made of a woven material such as a medium weight canvas, but other materials such as fabric made from man-made materials may be used. The expanded shape of the collapsible sack 24 may best be described as the frustrum of a cone. The sack 24 has a base portion 28, tapered sides 30, and a mouth portion 32. The base portion 28 has a centrally located aperture 34 therethrough. The aperture 34 formed in the bottom portion 28 is adapted to allow the sleeve member 26 to pass therethrough. The aperture 34 is further adapted for attaching the collapsible sack 24 to the sleeve member 26. Preferably the aperture 34 is formed by a plurality of radially extending cuts in the bottom portion 28 of the sack 24. These radial cuts preferably only extend to the outside diamenter of the tubing. The radial cuts result in tab member 36 which may be attached to the first end 38 of the tube 26. The tab member 36 are preferably attached to the sleeve 26 by a clamp 40. This clamp may be of conventional hose clamp and the like. A flanged bushing 42 may be used between the clamp 40 and the tab members 36 to insure that a sealed condition is maintained at the attachment point of the sack 24 to the sleeve 26.

The flange bushing 42 may be made of a suitable plastic material. This flanged bushing 42 will also provide a reinforcement of the fabric at the aperture. It is to be noted that the flange bushing and the clamping means made be of a unitary construction for ease of assembly and cost.

Referring still to FIG. 2, it is preferred that the elongated sleeve member 26 be of sufficient length to extend beyond the mouth portion 28 of the the sack 24. The adjustable securing means 22 carried on the second end 44 includes at least one threaded fastener 46 which is carried in a threaded aperture 48 formed in and through said second end 44. The securing means 22 may be a standard shaft collar with two thumb screws 46 being carried in threaded holes 48 for providing a three point gripping on the shaft 14, as may be more clearly seen in FIG. 3.

USE AND OPERATION

Figure 3:
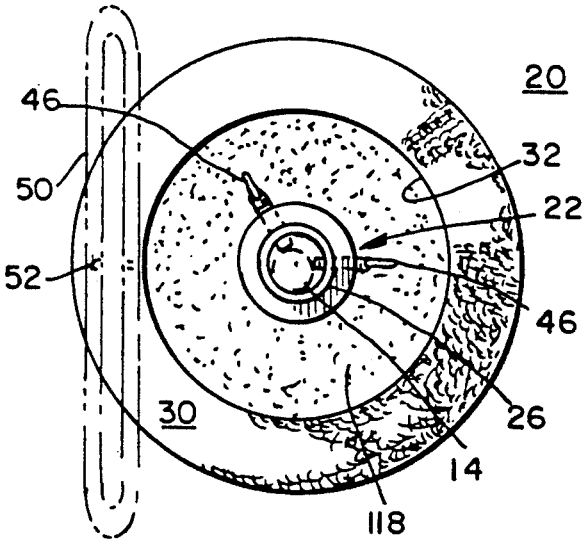
FIG. 3 represents a plan view of the stand as shown in FIG. 2, This view particularly showing the mouth portion.

Referring to FIG. 3, the stand 20 is stored or carried in a collapsed condition, with the sack 24 in a folded or wrapped condition abutting the sleeve 26. A carry handle 50, shown in dashed outline may be attached to the sack at attachment point 52. It is to be noted that the collapsed stand 20 may be easily carried on the shaft 14 of the umbrella due to its compact size and light weight.

For beach use, it is preferred that the shaft 14 of the umbrella 10 be inserted into the sleeve 26. The stand 20 may be temporarily secured to the shaft 14, at a non-interfering location, by tightening the securing means 22, to limit unwanted relative movement. The umbrella 10 is implanted into the sand or soil 18 to a determined amount of 30.4 cm. (12 in.). After the shaft has been implanted, the securing means 22 is loosened, allowing the stand 20 to be lowered so that the first end 38 of the sleeve 26 abuts the sand 18. The user then fills the sack 24 by way of the mouth 32 with suitable fill material 118 such as sand, soil or the like. The sack 24 may be filled or partially filled as needed. It is to be noted that the sack 24 has been shown to have an open mouth portion 32 but a closing means, may be provided, such as a draw string, to close the sack 24. It should also be pointed out that one advantage of a fillable sack 24 is that the bottom portion 28 of the sack 24 will follow the contour of the surface upon which it is resting. This allows the umbrella 10 to be placed in a substantially plum condition on sloped surfaces. The adjustable securing means 22 is used to secure the umbrella shaft 16 to the stand 20. This securing of the umbrella 10 to the filled stand 20 will provide additional weight to the umbrella to resist wind forces trying to lift the umbrella 10 from its implanted condition.

At the end of the day when it is desired to disassemble the umbrella 10 and stand 20, one need only loosen the securing means 22, and remove the shaft 14 from the stand 20. The stand 20 can be inverted to remove the fill material 118, so that the sack may be collapsed and brought to its compact size for transport. After emptying, the sack may be reversed to remove any sand or soil 118 clinging to its inside surface.

The sleeve 26 preferably is made of a lightweight metal such as aluminum tubing, but the use of other metals, or plastics is anticipated. It has been found that a tubing having an inside diameter of 3.8 cm. (1.5 in.) will receive most of the shaft 14 of available umbrellas. The flange diameter of the flanged bushing 42 preferably is between 10 and 12 cm. (2.5–3.0 in.). The mouth portion 32 may be provided with a hem as a reinforcement as well as to resist fraying of the fabric.

Terms such as "left", "right", "up", "down", "bottom", "top", "front", "back", "in", "out" and the like are applicable to the embodiments shown and described in conjunction with the drawings. These terms are merely for the purpose of description and do not necessarily apply to the position in which the stand of the present invention may be employed.

While these particular embodiments of a collapsible stand have been shown and described, it is to be understood that the invention is not limited thereto and protection is sought to the broadest extent the prior art allows.

What is claimed is:

1. A stand for adjustably receiving a selected portion of a shaft of a shade umbrella passing therethrough, said stand comprising:

a)-a collapsible sack portion being of a selected shape when in an expanded condition, said collapsible sack including a mouth portion and a base portion, said base portion of said collapsible sack having a selectively configured aperture therethrough, said selectively configured aperture being in substantial alignment with said mouth portion, said mouth portion of said sack further including a draw string closure means for gathering said mouth portion so as to abut said rigid tubular sleeve member;

b)-an elongated rigid tubular sleeve member having a selected inside diameter, a first end, and a second end, said first end being adapted for insertion into said selectively configured aperture in said base portion, said first end of said rigid tubular sleeve being further adapted for providing an attaching means to said base portion of said collapsible sack, said attaching means also providing a substantially sealed condition between said collapsible sack and said rigid tubular sleeve, said sleeve member being of sufficient length for allowing said second end to extend beyond said mouth portion, said rigid tubular sleeve being further adapted for allowing a shaft of a shade umbrella to pass therethrough for insertion into the soil;

c)-said second end being further adapted with a shaft securing means, said shaft securing means being adaptable to retain various sizes of umbrella shafts being received in and through said inside diameter or said rigid tubular sleeve member; and d)-wherein said collapible sack is adapted for being charged with a suitable material by way of said mouth portion as and when additional weight is necessary, said suitable material being retained interior of said sack by said closure means, said collapsible sack further adapted for being emptied of said suitable material by way of said mouth as and when desired, then collapsed inwardly around said rigid tubular sleeve.

2. A stand as recited in claim 1, wherein said selectively configured aperture includes a plurality of tab members for cooperating with said attaching means on said first end, a separation between each of said tab members extending only to a point substantially in line with an outside diameter of said rigid tubular sleeve member.

3. A stand as recited in claim 2 wherein said attaching means further includes a flanged bushing member for reinforcing said aperture while providing said sealing means.

4. A stand as recited in claim 1 wherein said securing means at said second end includes at least one threaded fastener for providing said retention.

5. A stand as recited in claim 1 wherein said selected shape of said expanded condition is substantially a frustum of a cone, said base portion being a base member of said frustrum of said cone.

6. A stand as recited in claim 1 which includes at least one flexible strap member being attached to a side wall of said collapsible sack, said flexible strap member adapted to provide a handle for carrying and transporting.

7. A stand as recited in claim 5 wherein said securing means at said second end includes at least one threaded fastener for providing said retention.

8. A stand as recited in claim 5 which includes at least one flexible strap member being attached to a side wall of said collapsible sack, said flexible strap member adapted to provide a handle for carrying and transporting.

9. A stand as recited in claim 5 wherein said collapsible sack is adapted for being collapsed around said rigid tubular sleeve in a substantially pleated array.

* * * * *